US010791774B2

(12) United States Patent
Plant et al.

(10) Patent No.: US 10,791,774 B2
(45) Date of Patent: Oct. 6, 2020

(54) GAMER HOODIE

(71) Applicant: HBI Branded Apparel Enterprises, LLC, Winston Salem, NC (US)

(72) Inventors: Andrew M. Plant, Winston-Salem, NC (US); Marlon J. Harris, Winston-Salem, NC (US)

(73) Assignee: HBI Branded Apparel Enterprises, LLC, Winston Salem, NC (US)

( * ) Notice: Subject to any disclaimer, the term of this patent is extended or adjusted under 35 U.S.C. 154(b) by 0 days.

(21) Appl. No.: 16/007,583

(22) Filed: Jun. 13, 2018

(65) Prior Publication Data

US 2019/0380398 A1 Dec. 19, 2019

(51) Int. Cl.
*A41D 1/04* (2006.01)
*A41D 1/00* (2018.01)
(Continued)

(52) U.S. Cl.
CPC ..... *A41D 1/005* (2013.01); *A41D 1/04* (2013.01); *A41D 27/08* (2013.01); *A41D 27/10* (2013.01);
(Continued)

(58) Field of Classification Search
CPC . A61B 5/6804; A61B 5/0022; A61B 5/04085; A61B 5/7455; A61B 5/7475; A61B 2562/12; A61B 5/024; A61B 5/4806; A61B 5/0002; A61B 5/6802; A61B 5/04; A61B 2560/04; A61B 2562/0209; A61B 5/0024; A61B 5/0478; A61B 5/486; A61B 5/74; H05K 1/0283; H05K 1/038; H05K 1/092; H05K 1/095; H05K 3/361; H05K 1/0393; H05K 1/16; H05K 2201/0281; A41D 13/1281; A41D 1/002; A41D 27/00; A41D 13/1236; A41D 27/205; A41D 13/0012; A41D 13/0017; A41D 1/22;
(Continued)

(56) References Cited

U.S. PATENT DOCUMENTS 796,711 A 8/1905 Ferguson
2,079,220 A 5/1937 Mahoney
(Continued)

FOREIGN PATENT DOCUMENTS

CN 203194581 9/2013
DE 102011122751 7/2013
(Continued)

OTHER PUBLICATIONS

No Author, "KontrolFreek® Launces Performance Gaming Wear TM" Atlanta, GA, Jan. 24, 2017, 2 pages.
(Continued)

*Primary Examiner* — Robert H Muromoto, Jr.
(74) *Attorney, Agent, or Firm* — Fish & Richardson P.C.

(57) ABSTRACT

A hooded garment can include a torso section extending from a waist region to a neck region, where the torso section includes a chest region and a back region. The hooded garment includes a hood extending upward from the neck region and having a front opening, a right sleeve extending from a right shoulder region of the right torso region and having a first wrist opening, and a left sleeve extending from a left shoulder region of the left torso region and having a second wrist opening.

30 Claims, 11 Drawing Sheets

(51) Int. Cl.
*A41D 27/08* (2006.01)
*A41D 27/10* (2006.01)
*A41D 27/20* (2006.01)
*A41D 23/00* (2006.01)

(52) U.S. Cl.
CPC ..... *A41D 27/201* (2013.01); *A41D 27/205* (2013.01); *A41D 2200/20* (2013.01); *A41D 2300/32* (2013.01); *A41D 2300/322* (2013.01); *A41D 2300/324* (2013.01); *A41D 2400/48* (2013.01); *A41D 2600/00* (2013.01)

(58) Field of Classification Search
CPC ..... A41D 2400/46; A41D 2600/10; A41D 27/20; A41D 27/208; A41D 1/005
See application file for complete search history.

(56) References Cited

U.S. PATENT DOCUMENTS 2,558,533 A 6/1951 Bell
D250,226 S 11/1978 Shaw
4,689,831 A 9/1987 Greenberger
D355,752 S 2/1995 Abbott
5,400,440 A * 3/1995 Clifford ..... A42B 1/067 2/172
5,718,000 A 2/1998 Ost et al.
5,784,719 A 7/1998 Robinson
5,813,051 A * 9/1998 Counter ..... G09F 21/02 2/102
5,819,728 A * 10/1998 Ritchie ..... A62B 17/04 128/201.23
5,845,334 A * 12/1998 Marcolini, Jr. ..... A41D 27/08 2/69
D404,539 S 1/1999 Glasser
D411,576 S 6/1999 Hames
5,950,240 A 9/1999 Carpenter et al.
5,987,644 A 11/1999 Mengato
D439,029 S 3/2001 Goldman
RE38,497 E 4/2004 Falk et al.
7,318,239 B2 * 1/2008 Wood ..... A41D 13/012 2/108
7,519,192 B1 * 4/2009 Laycock ..... A41D 1/005 381/301
7,761,930 B2 7/2010 Krause et al.
D636,973 S 5/2011 Smith
7,945,971 B2 * 5/2011 Garza ..... A42B 1/225 2/171.4
7,992,225 B2 8/2011 Demus
D692,212 S 10/2013 Coward
8,549,670 B2 10/2013 Demus
8,613,112 B2 12/2013 Santucci et al.
8,677,515 B2 3/2014 Ishihara et al.
D711,627 S 8/2014 Badr
8,910,315 B1 12/2014 Stephens
8,945,328 B2 * 2/2015 Longinotti-Buitoni ..... A61B 5/0002 156/234
9,271,533 B2 3/2016 Kochling
9,282,893 B2 * 3/2016 Longinotti-Buitoni ..... A61B 5/6804
9,456,639 B2 10/2016 Aylward
9,504,283 B2 11/2016 Gheneva et al.
9,743,743 B2 * 8/2017 Grote ..... A45F 5/00
9,817,440 B2 * 11/2017 Longinotti-Buitoni ..... A61B 5/6804
9,986,771 B2 * 6/2018 Longinotti-Buitoni ..... A61B 5/0002
10,045,439 B2 * 8/2018 Longinotti-Buitoni ..... A61B 5/6804
10,143,249 B2 12/2018 West
10,194,705 B2 * 2/2019 Amrhein ..... A41D 13/0015
10,463,085 B2 11/2019 McGargill
10,529,257 B1 * 1/2020 Peelgrane ..... G09F 7/18
2002/0088046 A1 * 7/2002 Fidler ..... A41B 13/00 2/80
2003/0144039 A1 * 7/2003 Lin ..... A41D 1/005 455/575.2
2004/0221360 A1 * 11/2004 Wood ..... A41D 13/012 2/69
2008/0184459 A1 8/2008 Barnes
2009/0262967 A1 * 10/2009 Bryan ..... H04R 5/02 381/333
2010/0071110 A1 3/2010 Stevens
2010/0329499 A1 * 12/2010 Wolfe ..... A41D 1/002 381/376
2011/0119800 A1 5/2011 Garrido et al.
2011/0185469 A1 8/2011 Santuccio et al.
2011/0185471 A1 * 8/2011 Buczkowski ..... A41D 27/20 2/84
2012/0060261 A1 3/2012 Raviv
2012/0185999 A1 * 7/2012 Raviv ..... A41D 27/205 2/247
2014/0070957 A1 * 3/2014 Longinotti-Buitoni ..... A61B 5/6804 340/870.01
2014/0231277 A1 8/2014 Ponski
2014/0318699 A1 * 10/2014 Longinotti-Buitoni ..... A61B 5/0002 156/247
2015/0040282 A1 * 2/2015 Longinotti-Buitoni ..... A61B 5/6804 2/69
2015/0143601 A1 * 5/2015 Longinotti-Buitoni ..... A61B 5/0002 2/69
2015/0144673 A1 5/2015 Dahl et al.
2015/0189931 A1 7/2015 Elliott
2015/0296900 A1 10/2015 Huang et al.
2016/0198781 A1 * 7/2016 Israel ..... A41D 23/00 2/84
2016/0200386 A1 7/2016 Jarmon
2016/0206017 A1 * 7/2016 Aylward ..... A41D 27/205
2017/0086569 A1 * 3/2017 Grote ..... A45F 5/00
2017/0196513 A1 * 7/2017 Longinotti-Buitoni ..... A61B 5/6804
2017/0318943 A1 * 11/2017 Grote ..... A45F 5/00
2018/0067516 A1 * 3/2018 Longinotti-Buitoni ..... A61B 5/6804
2018/0376586 A1 * 12/2018 Longinotti-Buitoni ..... A61B 5/0002
2019/0014842 A1 * 1/2019 Israel ..... A41D 3/08
2019/0132948 A1 * 5/2019 Longinotti-Buitoni ..... D06N 3/0063

FOREIGN PATENT DOCUMENTS

DE 202015004885 8/2015
GB 2494142 3/2013
KR 20130005170 8/2013
TW 200711586 4/2007
WO WO2002087386 11/2002
WO 2009150026 12/2009
WO 2011119133 9/2011

OTHER PUBLICATIONS

International Search Report and Written Opinion in International Application No. PCT/US2019/036621, dated Dec. 20, 2019, 16 pages.
International Search Report and Written Opinion in International Application No. PCT/US2018/065162, dated Aug. 8, 2019, 25 pages.
International Invitation to Pay Additional Fees in International Application No. PCT/US2018/065162, dated Apr. 29, 2019, 21 pages.

* cited by examiner

GAMER HOODIE

TECHNICAL FIELD

This instant specification relates to a garment, and, more particularly to a garment having features for use in electronic gaming activities.

BACKGROUND

In recent years, garments designed as outerwear have been developed to provide more than just warmth and protection. Consumers value storage spaces and ease of access, regardless of whether the garment is used for outdoor activities, such as hiking or camping, or for more urban daily use.

Electronic devices, such as cell phones, media players, and smartphones are now common accessories that consumers carry and use constantly, regardless of the activity. Easy access to these electronic devices and being able to utilize the many features that these devices offer has become increasingly important for consumers. The ability to carry, use and operate such a device, e.g., navigate from one song to the next or one application to the next, is desirable.

Electronic gaming has increased in popularity. Simple "pong" type games that were once played in isolation or pairs at home have evolved into interconnected gaming environments. Enthusiasts have elevated the status of such activities from mere "games" to the level of competitive spectator sports, complete with live tournaments, teams, broadcasts, and sponsorships. And similar to the way that athletic competitors value their personal equipment and would never go into competition without it (e.g., their own shoes, custom golf clubs, specially tuned bicycles, rackets, bowling balls, baseball gloves), competitive gamers value the use of their own personal equipment as well (e.g., customized/specialized gaming controllers and/or keyboards, communications equipment, eyewear).

There are known garment designs that allow interconnectivity between multiple devices positioned in different pockets. The more common electronic devices used by consumers today, however, perform multiple functions, e.g., a single device is a cell phone, a web browser, and a media player, with features that several years ago would have required two or more devices to perform. A suitable garment design that allows electronic gaming enthusiasts to hold and enhance the use of personal electronic gaming equipment and the wires associated with the equipment has not heretofore been known.

SUMMARY

In general, this document describes a garment, and, more particularly to a garment having features for use in electronic gaming activities.

In a first aspect, a hooded garment includes a torso section extending from a waist region to a neck region, wherein the torso section comprises a chest region and a back region, the back region comprising a vertical pocket having a pocket opening formed in an upper half of the back region and defining a space having a depth between the neck region and the waist region that is longer than a width between a left torso region and a right torso region, a hood extending upward from the neck region and having a front opening, a right sleeve extending from a right shoulder region of the right torso region and having a first wrist opening, and a left sleeve extending from a left shoulder region of the left torso region and having a second wrist opening.

Various embodiments can include some, all, or none of the following features. The torso section can include at least one of a front right pocket having a first opening in the right torso region proximal the waist region on the chest region, the first opening being at least partly oriented toward the left torso region across the chest region, and a front left pocket having a second opening in the left torso region proximal the waist region on the chest region, the second opening being at least partly oriented toward the right torso region across the chest region. The torso section includes at least one of a back right pocket having a first opening in the right torso region proximal the waist region on the back region, the first opening being at least partly oriented toward the left torso region across the back region, and a back left pocket having a second opening in the left torso region proximal the waist region on the back region, the second opening being at least partly oriented toward the right torso region across the back region. At least one of the right sleeve and the left sleeve can also include a channel having at least a first opening proximal the neck region and a second opening proximal at least one of an elbow region and the first wrist opening or the second wrist opening. The hooded garment can also include an electrical cord assembly comprising a plurality of electrically isolated conductors at least partly retained within the channel, the electrical cord assembly having a first end proximal the neck region and extending to a second end proximal at least one of the elbow region and the first wrist opening or the second wrist opening. At least one of the right sleeve and the left sleeve can also include a retainer configured to be affixed to an electronic game controller. At least one of the right sleeve and the left sleeve can also include an electronic device pocket proximal the first wrist opening or the second wrist opening and having a substantially transparent window configured to permit viewing of a display of an electronic device secured within the electronic device pocket. The hooded garment can include one or more affixment points configured to removably affix ornamental patches to the hooded garment. The vertical pocket can be configured to hold a first portion of a personal computer (PC) gaming keyboard in a vertical orientation, and a second portion of the keyboard visibly extends vertically through the pocket opening toward the neck region.

In a second aspect, a hooded garment includes a torso section extending from a waist region to a neck region, wherein the torso section has a chest region and a back region, a hood extending upward from the neck region and having a front opening, a right sleeve extending from a right shoulder region of a right torso region and having a first wrist opening, and a left sleeve extending from a left shoulder region of a left torso region and having a second wrist opening, wherein the torso section also includes at least one of a front right pocket having a first opening in the right torso region proximal the waist region on the chest region, the first opening being at least partly oriented toward the left torso region across the chest region, a front left pocket having a second opening in the left torso region proximal the waist region on the chest region, the second opening being at least partly oriented toward the right torso region across the chest region, a back right pocket having a third opening in the right torso region proximal the waist region on the back region, the third opening being at least partly oriented toward the left torso region across the back region, and a back left pocket having a fourth opening in the left torso region proximal the waist region on the back region, the fourth opening being at least partly oriented toward the right torso region across the back region.

Various embodiments can include some, all, or none of the following features. At least one of the right sleeve and the left sleeve can also include a channel having at least a first opening proximal the neck region and a second opening proximal at least one of an elbow region and the first wrist opening or the second wrist opening. The hooded garment can also include an electrical cord assembly having a plurality of electrically isolated conductors at least partly retained within the channel, the electrical cord assembly having a first end proximal the neck region and extending to a second end proximal at least one of the elbow region and the first wrist opening or the second wrist opening. At least one of the right sleeve and the left sleeve can also include a retainer configured to be affixed to an electronic game controller. At least one of the right sleeve and the left sleeve can also include an electronic device pocket proximal first wrist opening or the second wrist opening and comprising a substantially transparent window configured to permit viewing of a display of an electronic device secured within the electronic device pocket. The hooded garment can also include one or more affixment points configured to removably affix ornamental patches to the hooded garment. The back region can also include a vertical pocket having an opening formed in an upper half of the back region and defining a space having a depth between the neck region and the waist region that is longer than a width between a left torso region and a right torso region. The vertical pocket can be configured to hold a first portion a personal computer (PC) gaming keyboard in a vertical orientation, and a second portion of the keyboard visibly extends vertically through the opening toward the neck region.

In a third aspect, a hooded garment includes a torso section extending from a waist region to a neck region, wherein the torso section has a right torso region, a left torso region, a chest region, and a back region, a hood extending upward from the neck region and having a front opening, a right sleeve extending from a right shoulder region of the right torso region and having a first wrist opening, and a left sleeve extending from a left shoulder region of the left torso region and having a second wrist opening, wherein at least one of the right sleeve and the left sleeve also includes a channel having at least a first opening proximal the neck region and a second opening proximal at least one of an elbow region and the first wrist opening or the second wrist opening.

Various embodiments can include some, all, or none of the following features. The torso section can include at least one of a front right pocket having a first opening in the right torso region proximal the waist region on the chest region, the first opening being at least partly oriented toward the left torso region across the chest region, and a front left pocket having a second opening in the left torso region proximal the waist region on the chest region, the second opening being at least partly oriented toward the right torso region across the chest region. The torso section can include at least one of a back right pocket having a first opening in the right torso region proximal the waist region on the back region, the first opening being at least partly oriented toward the left torso region across the back region, and a back left pocket having a second opening in the left torso region proximal the waist region on the back region, the second opening being at least partly oriented toward the right torso region across the back region. The hooded garment can also include an electrical cord assembly having a plurality of electrically isolated conductors at least partly retained within the channel, the electrical cord assembly having a first end proximal the neck region and extending to a second end proximal at least one of the elbow region and the first wrist opening or the second wrist opening. At least one of the right sleeve and the left sleeve can also include a retainer configured to be affixed to an electronic game controller. At least one of the right sleeve and the left sleeve can also include an electronic device pocket proximal the first wrist opening or the second wrist opening and having a substantially transparent window configured to permit viewing of a display of an electronic device secured within the electronic device pocket. The hooded garment can also have one or more affixment points configured to removably affix ornamental patches to the hooded garment. The back region can also have a vertical pocket having an opening formed in an upper half of the back region and defining a space having a depth between the neck region and the waist region that is longer than a width between a left torso region and a right torso region. The vertical pocket can be configured to hold a first portion of a personal computer (PC) gaming keyboard in a vertical orientation, and a second portion of the keyboard visibly extends vertically through the opening toward the neck region.

In a fourth aspect, a hooded garment includes a torso section extending from a waist region to a neck region, wherein the torso section has a right torso region, a left torso region, a chest region and a back region, a hood extending upward from the neck region and having a front opening, a right sleeve extending from a right shoulder region of the right torso region and having a first wrist opening, and a left sleeve extending from a left shoulder region of the left torso region and having a second wrist opening, wherein at least one of the right sleeve and the left sleeve also includes an electronic device pocket proximal the corresponding left wrist opening or right wrist opening and comprising a substantially transparent window configured to permit viewing of a display of an electronic device secured within the electronic device pocket.

Various embodiments can include some, all, or none of the following features. The torso section can include at least one of a front right pocket having a first opening in the right torso region proximal the waist region on the chest region, the first opening being at least partly oriented toward the left torso region across the chest region, and a front left pocket having a second opening in the left torso region proximal the waist region on the chest region, the second opening being at least partly oriented toward the right torso region across the chest region. The torso section can include at least one of a back right pocket having a first opening in the right torso region proximal the waist region on the back region, the first opening being at least partly oriented toward the left torso region across the back region, and a back left pocket having a second opening in the left torso region proximal the waist region on the back region, the second opening being at least partly oriented toward the right torso region across the back region. At least one of the right sleeve and the left sleeve can also include a channel having at least a first opening proximal the neck region and a second opening proximal at least one of an elbow region and the first wrist opening or the second wrist opening. The hooded garment can also include an electrical cord assembly having a plurality of electrically isolated conductors at least partly retained within the channel, the electrical cord assembly having a first end proximal the neck region and extending to a second end proximal at least one of the elbow region, the first wrist opening or the second wrist opening, and the electronic device pocket. At least one of the right sleeve and the left sleeve can also include a retainer configured to be affixed to an electronic game controller. The hooded garment can also include one or more affixment points configured to removably affix ornamental patches to the hooded garment. The back region can also include a vertical pocket having an opening formed in an upper half of the back region and defining a space having a depth between the neck region and the waist region that is longer than a width between a left torso region and a right torso region. The vertical pocket can be configured to hold a first portion of a personal computer (PC) gaming keyboard in a vertical orientation, and a second portion of the keyboard visibly extends vertically through the opening toward the neck region. The substantially transparent window can be a material that permits interaction between a user and a capacitive touchscreen user interface within the electronic device pocket.

The garments described here may provide one or more of the following advantages. First, a garment can provide features that enhance an electronic gaming experience. Second, the garment can provide pockets that are oriented for use with electronic gaming accessories. Third, the garment can provide pockets that can be accessed in tight quarters and/or seated positions. Fourth, the garment can transport and display electronic gaming accessories. Fifth, the garment can provide features that enhance the visibility of promotional materials.

The details of one or more implementations are set forth in the accompanying drawings and the description below. Other features and advantages will be apparent from the description and drawings, and from the claims.

DETAILED DESCRIPTION

Figure 1A:
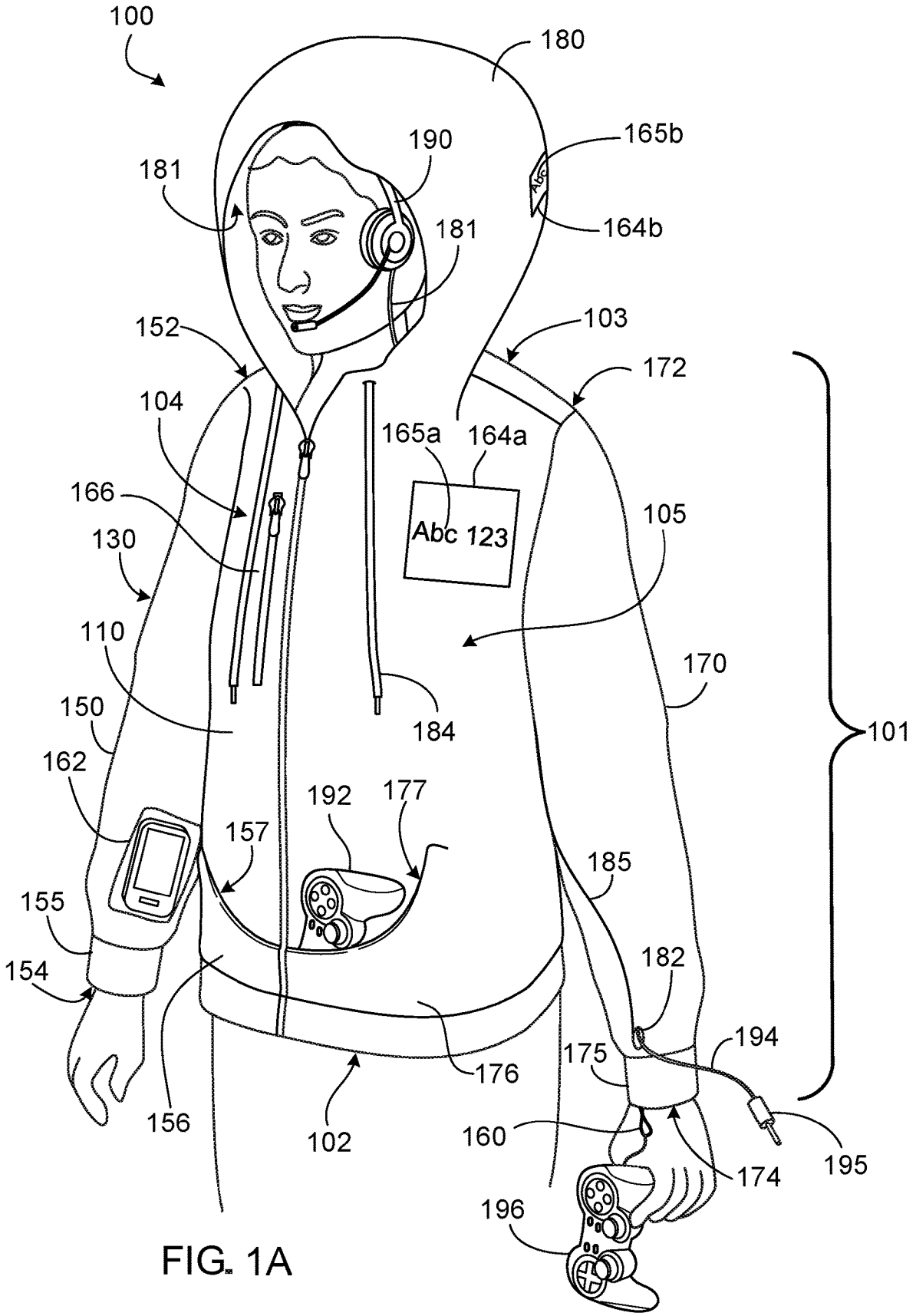
FIGS. 1A-1C are a front views of an example garment.
Figure 1B:
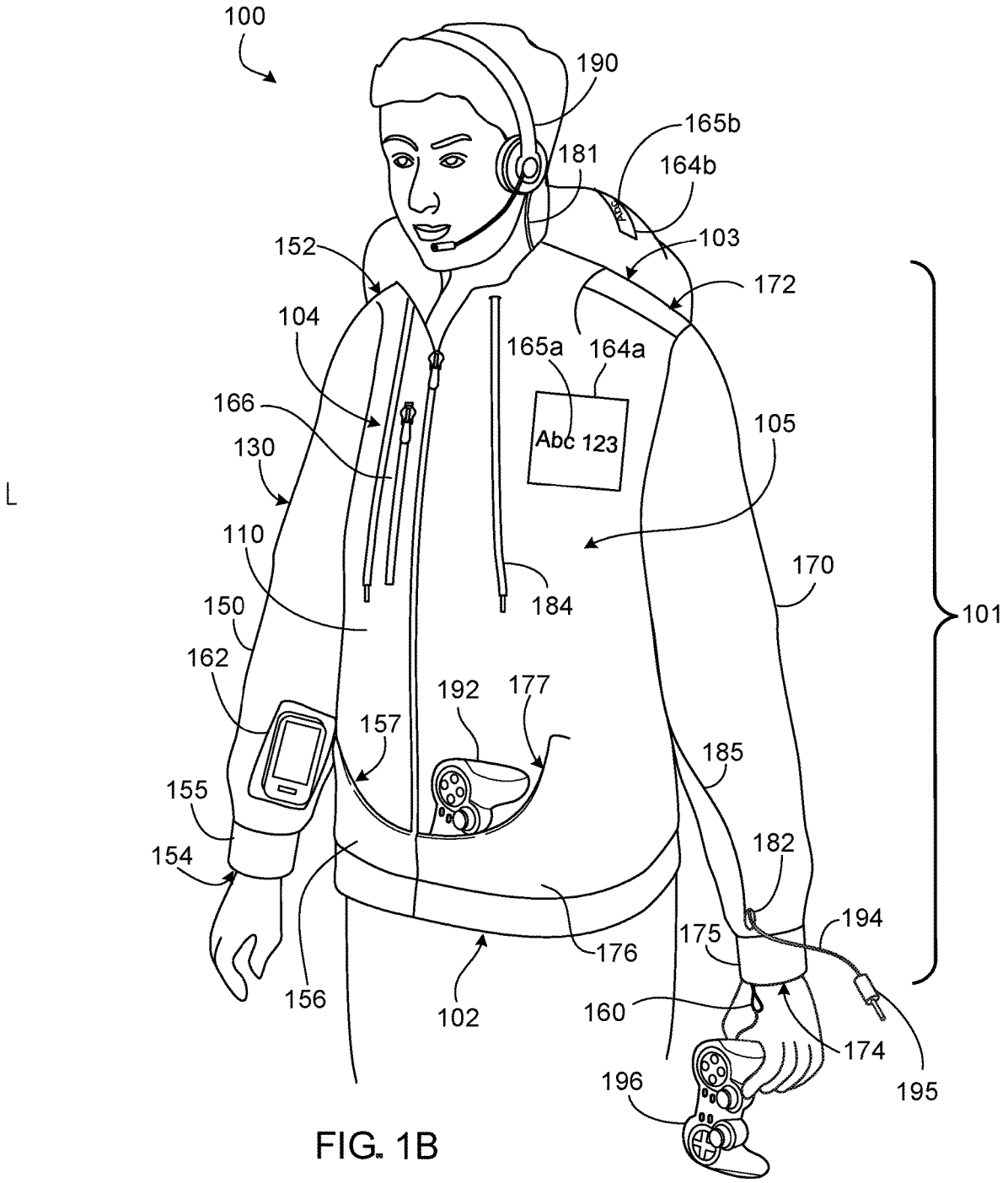
Figure 1C:
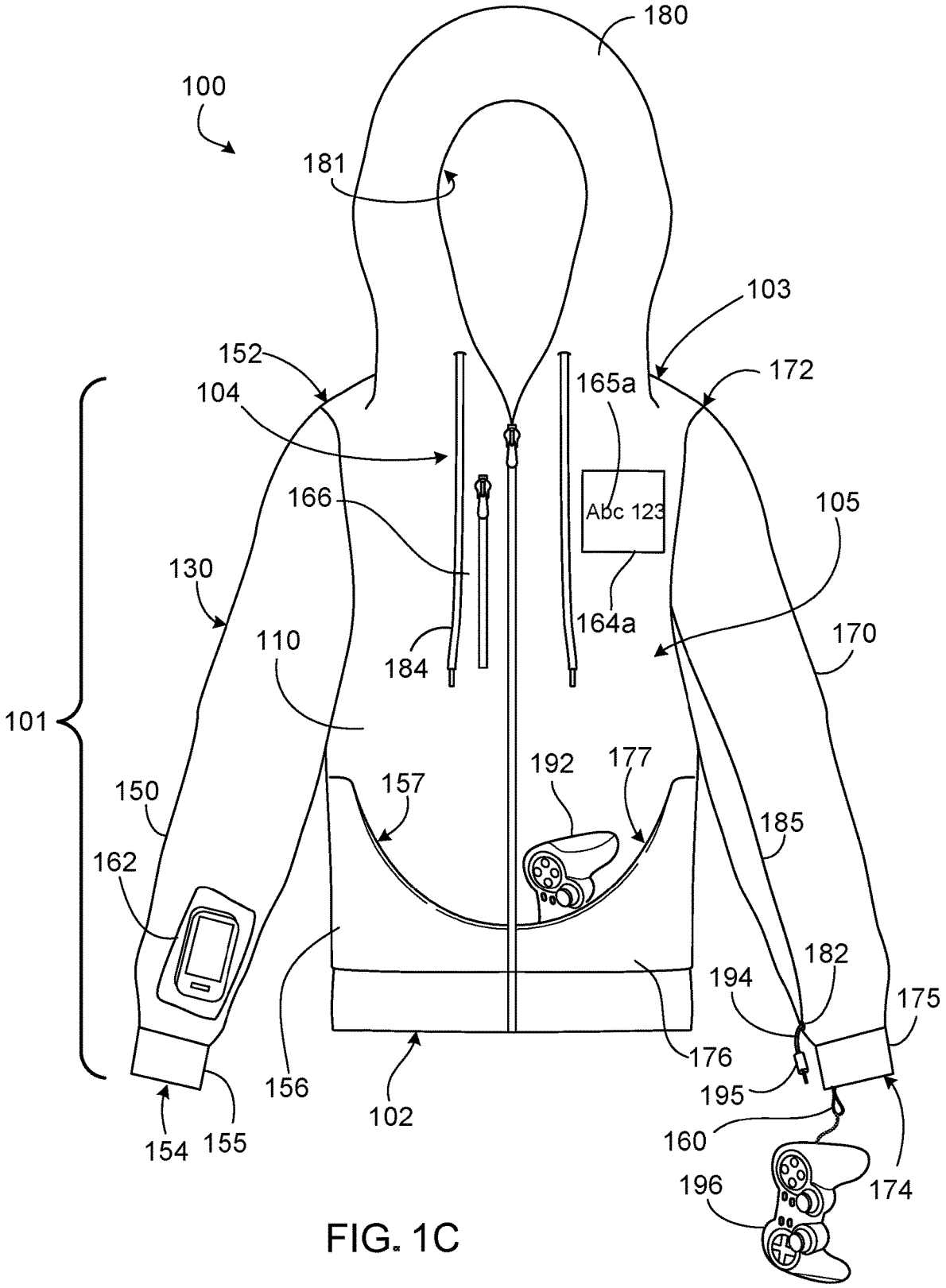

This document describes an upper-wear garment with features that can enhance the wearer's ability to organize, transport, and use electronic devices such as electronic gaming equipment. Electronic gaming enthusiasts often prefer to play using their own personally selected and/or customized gaming controllers, mice, keyboards, communication headsets, and other equipment. Some electronic gaming enthusiasts also wear clothing or accessories that can help them avoid external distractions and better focus on their game displays. For some gamers, the basic garment of choice is a hooded garment, commonly referred to as a "hoodie", which can be down over the player's head and drawn partly closed about the wearer's face to block out portions of the wearer's peripheral vision and help the wearer maintain focus straight ahead (e.g., toward their gaming screen).

FIGS. 1A-8 show various views of an example garment 100. In general, the garment 100 is configured as a hooded garment, commonly referred to as a "hoodie", which includes pockets, cord organizers, and other features that are sized and oriented in configurations that address some of the unique equipment and needs of electronic gaming enthusiasts.

Base Structure

The design of the example garment 100 is generally based on the design of hooded sweatshirts, commonly known as "hoodies". The garment 100 includes a torso region 101 extending from a waist region 102 to a neck region 103. The torso region 101 includes a chest region 110 (FIGS. 1A-1C) configured to substantially cover a wearer's chest, and a back region 130 (FIGS. 2A-3) configured to substantially cover the wearer's back. In the illustrated example, the chest region 110 includes a closure fastener 112, such as a zipper, that extends from the neck region 103 to the waist region 102. The closure fastener 112 is configured to open and reclose to ease the process of donning and removing the garment 100. In some embodiments, the closure fastener 112 may extend only part of the way from the neck region 103 to the waist region 102 (e.g., a half-hoodie). In some embodiments, the closure fastener 112 may be omitted (e.g., a pullover hoodie).

A right sleeve 150 extends from a right shoulder region 152 of a right torso region 104 and has a wrist opening 154. A left sleeve 170 extends from a left shoulder region 172 of a left torso region 105 and has a wrist opening 174. In the illustrated embodiment, the right wrist opening 154 is bordered by an expandable cuff 155 and the left wrist opening 174 is bordered by an expandable cuff 175. The cuffs 155, 175 are partly elastic and configured to at draw the wrist openings 154, 174 at least partly closed against the wearer's wrists.

Hood

The garment 100 includes a hood 180. The hood 180 extends upward from the neck region 103. The hood 180 is configured to be pulled up and over much of the wearer's head when in use, and has a front opening 181 for the wearer's face. A drawstring 184 is threaded through a passageway (not shown) within the periphery of the front opening 181. In use, the drawstring 184 can be tensioned in order to draw the front opening 181 at least partly closed around the wearer's face.

The hood 180 differs from the hoods of traditional "hoodies" in several ways. The hood 180 is oversized compared to traditional hoods. For example, the hood 180 is configured to provide room for not just the wearer's head, but also to provide room for a communication headset 190 worn by the wearer. The hood 180 is also constructed to provide relatively greater acoustic insulation compared to traditional hoods. The hood 180 is made up of two or more layers of cloth and/or sound deadening materials. In use, the hood 180 can provide at least partial acoustic isolation for the wearer. In some implementations, compared to traditional hoods, the hood 180 can provide relatively greater immersion in a game or other task by at least partly isolating the wearer from audible distractions beyond the game (e.g., to help focus on sounds provided by the communication headset 190).

In another example, the hood 180 is configured to project the front opening 181 forward beyond the wearer's face. In use, this additional depth can be used to intentionally reduce the wearer's peripheral vision (e.g., to provide "blinders" to block out distractions around a gaming screen). In some implementations, compared to traditional hoods, the hood 180 can provide relatively greater immersion in a game or other task by at least partly isolating the wearer from visual distractions beyond the game (e.g., to help focus on the gaming screen). In some implementations, the hood 180 can also be used to retain gaming or other accessories. For example, the wearer can store the communication headset 190 in the hood 180 when the hood 180 is down.

Keyboard Sheath

Figure 2A:
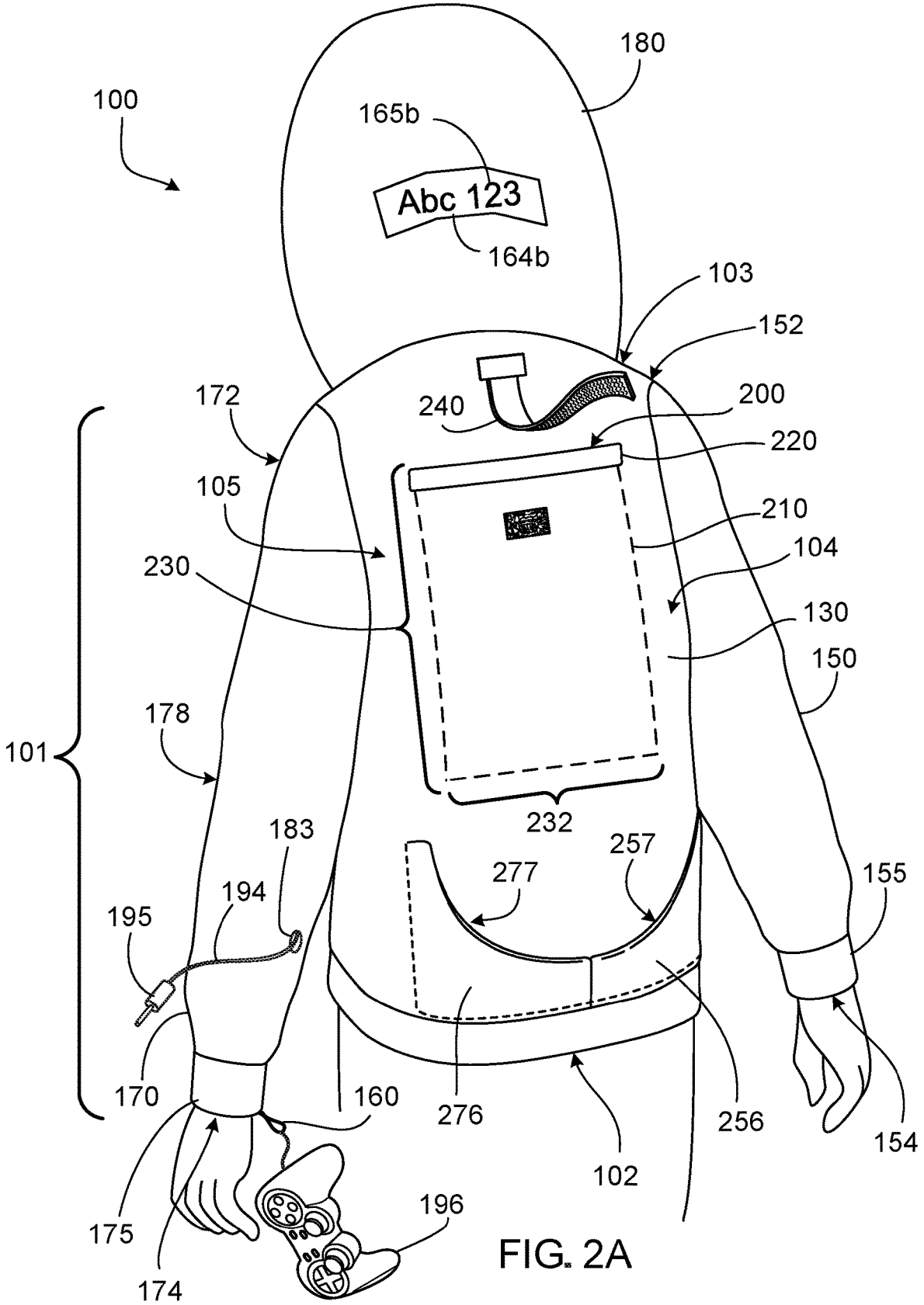
FIGS. 2A-2C are a rear views of the example garment of FIGS. 1A-1C.
Figure 2B:
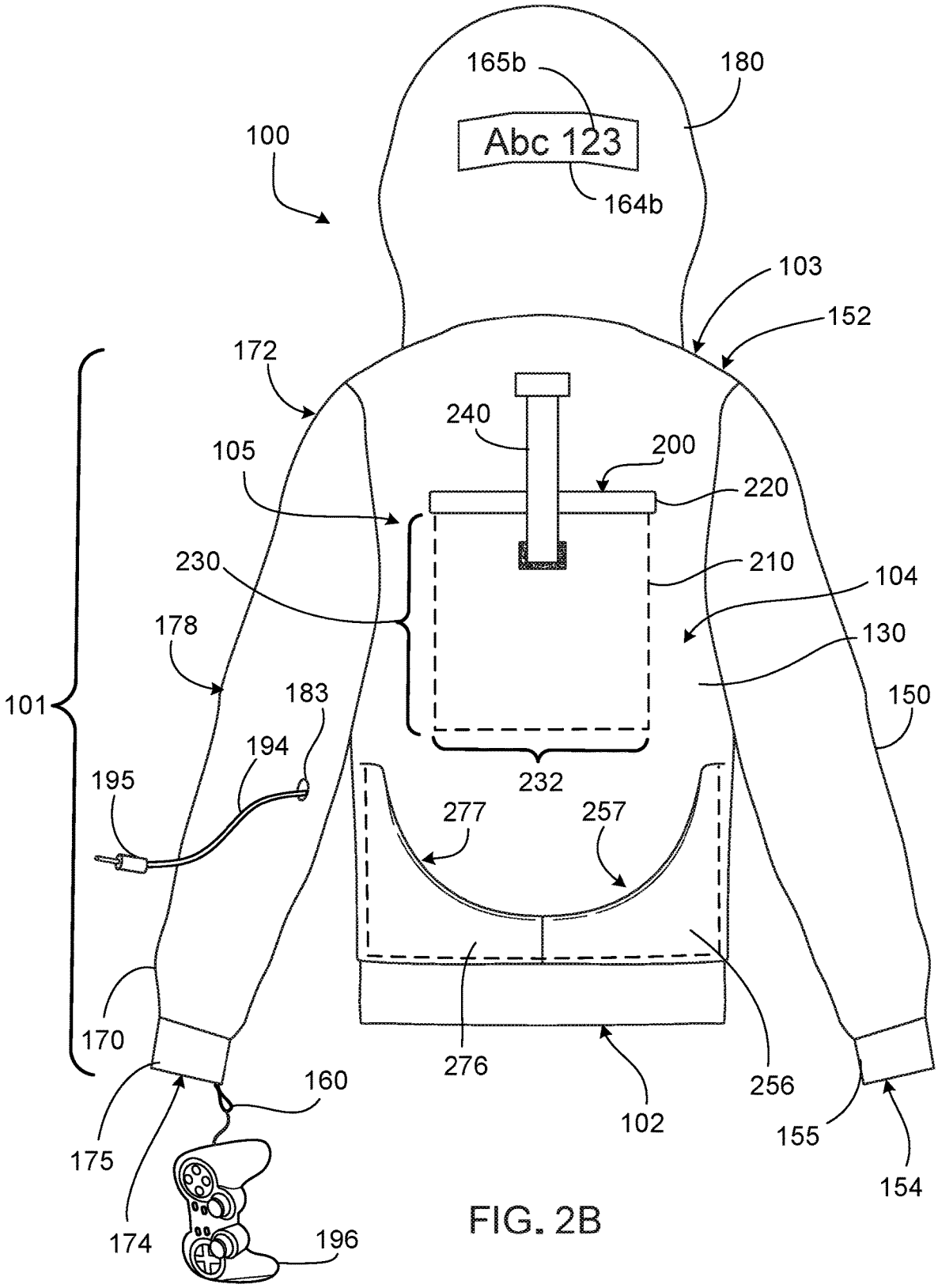
Figure 2C:
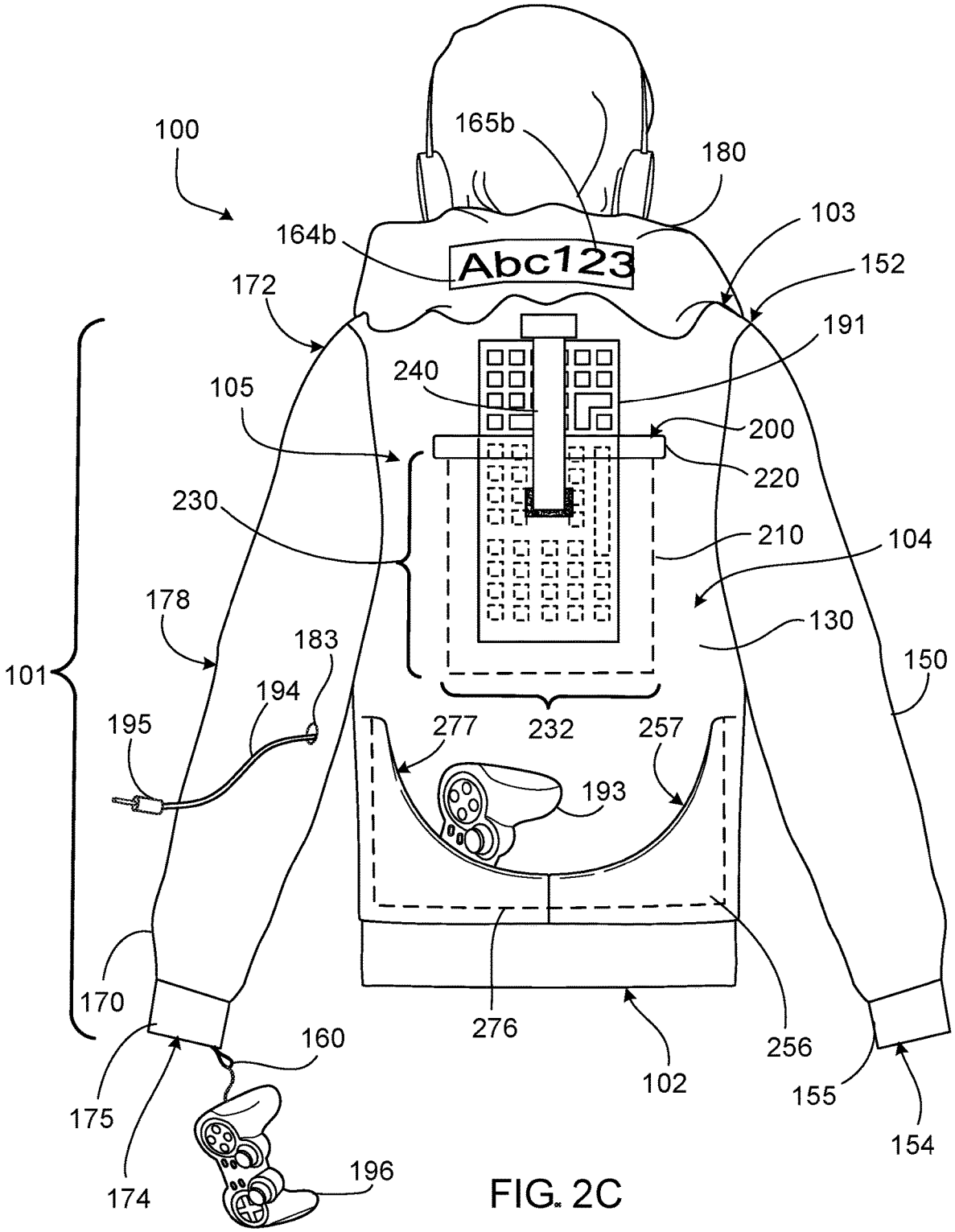
Figure 3:
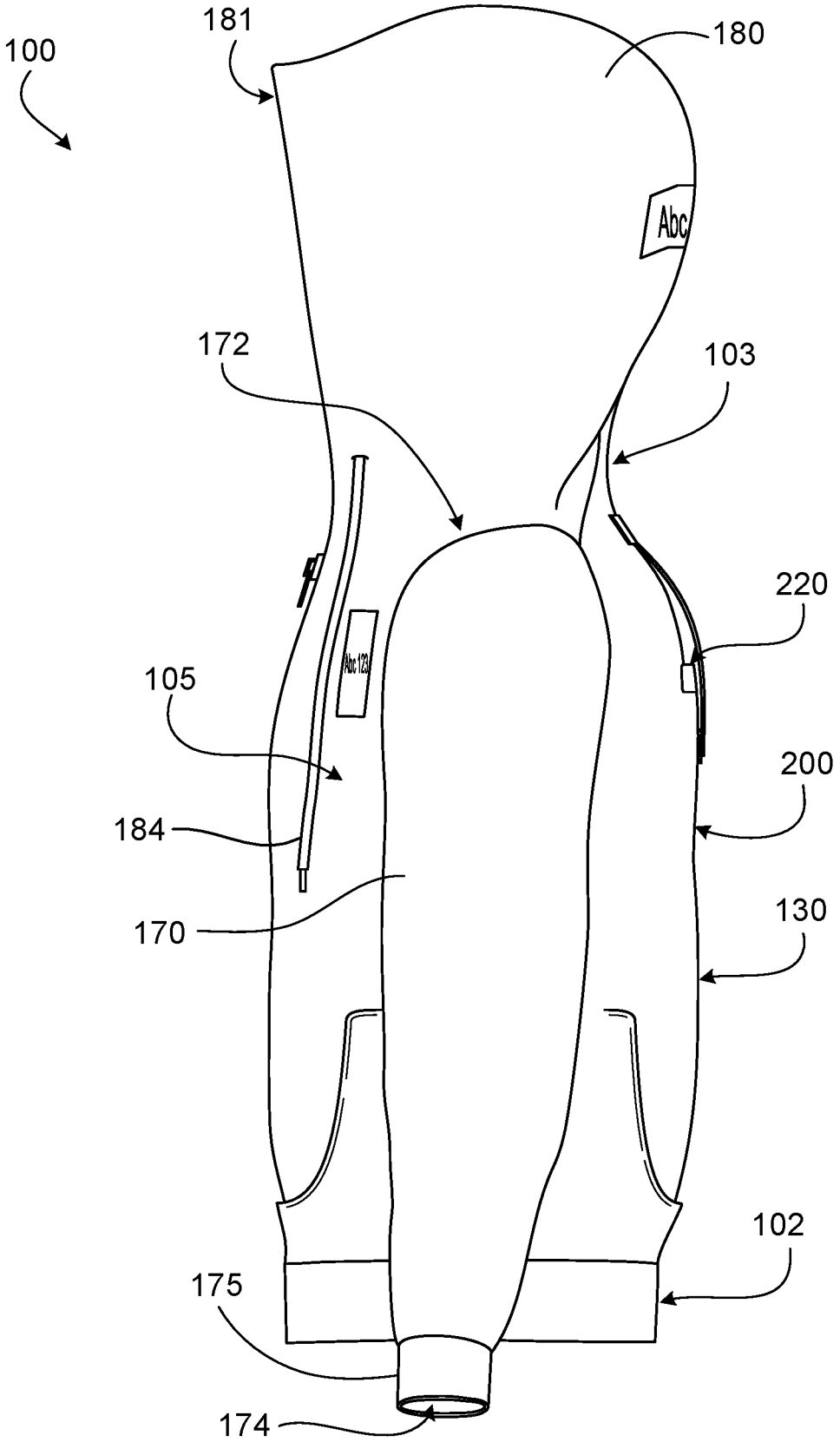
FIG. 3 is a left side view of the example garment of FIGS. 1A-2C.
Figure 4:
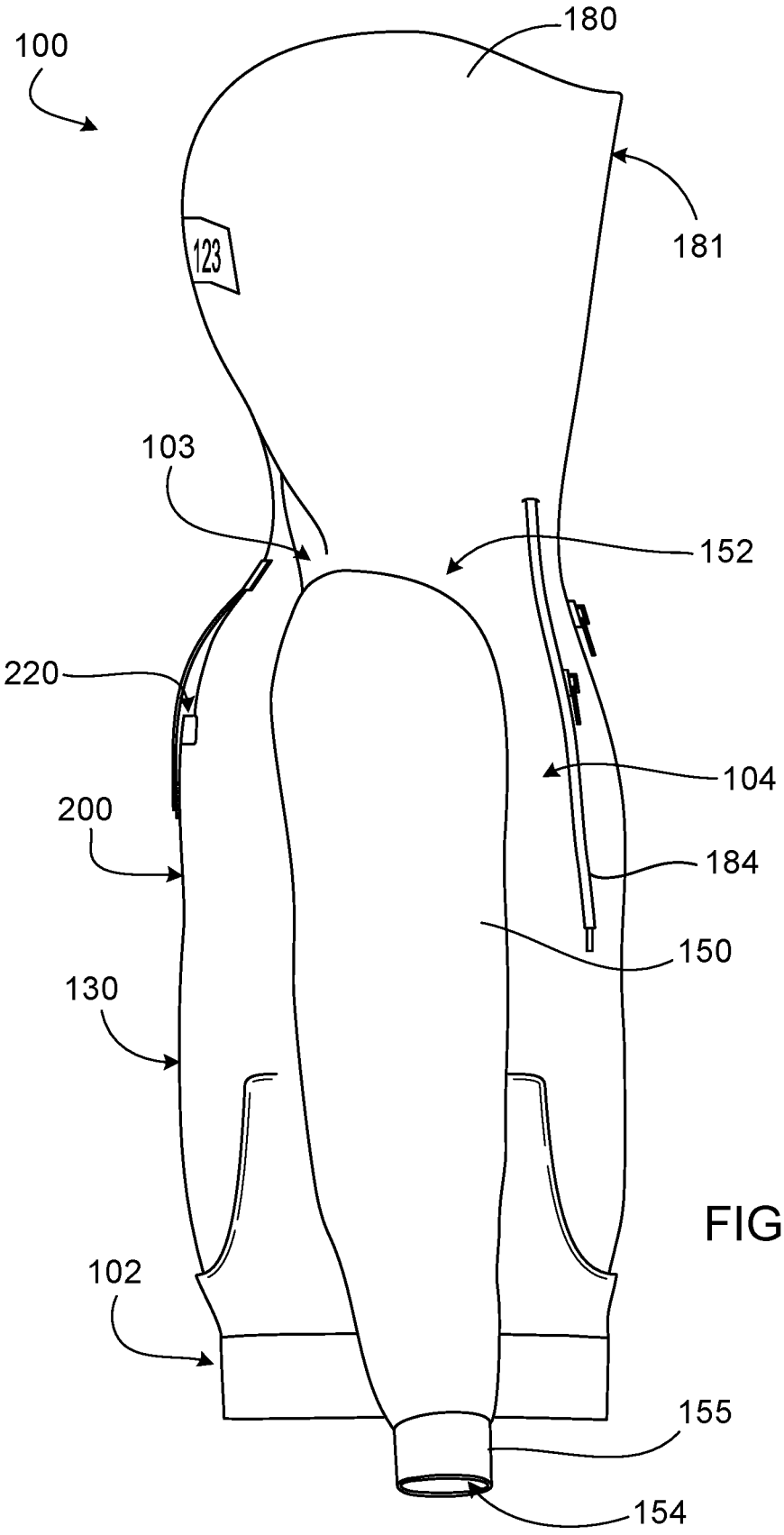
FIG. 4 is a left side view of the example garment of FIGS. 1A-3.
Figure 5:
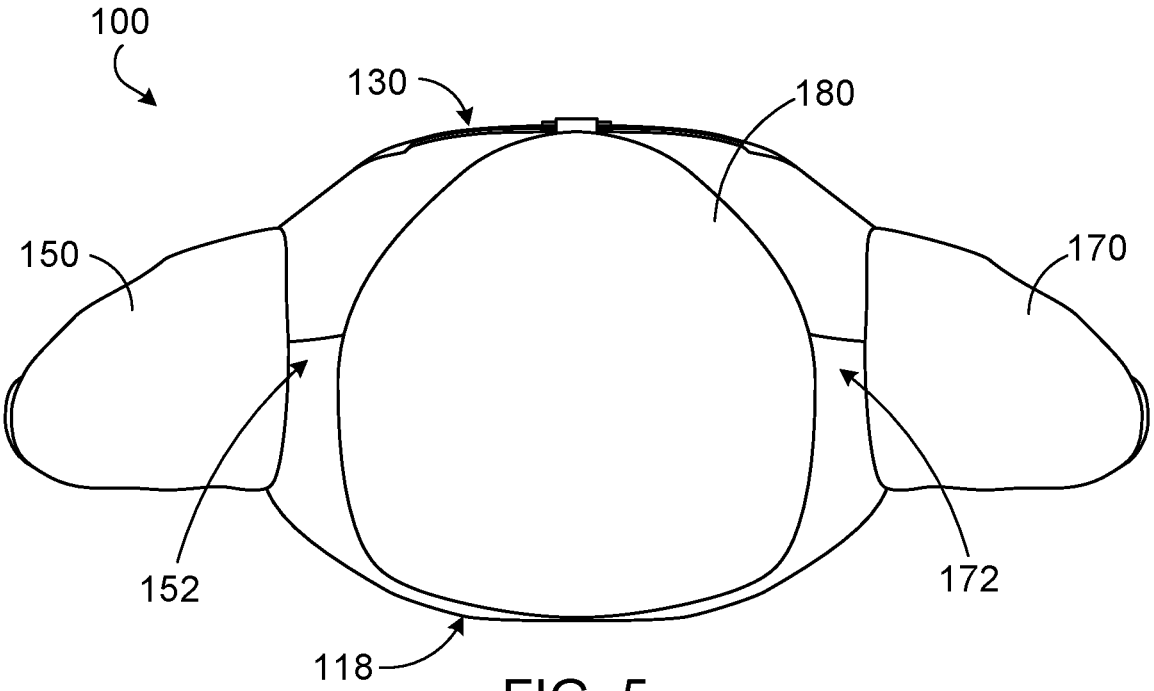
FIG. 5 is a top view of the example garment of FIGS. 1A-4.
Figure 6:
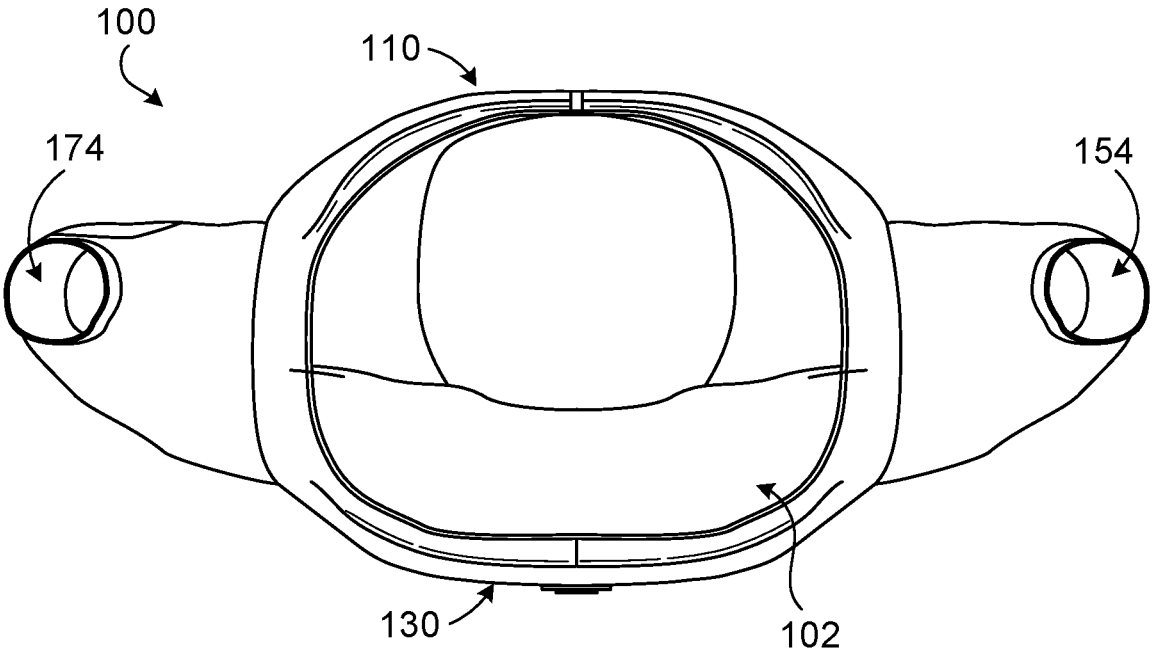
FIG. 6 is an underside view of the example garment of FIGS. 1A-5.

Referring mostly now to FIGS. 2A-2C, the example garment 100 includes a keyboard sheath 200. The keyboard sheath 200 is a vertically oriented pocket 210 in the back region 130. The keyboard sheath 200 includes an opening 220 formed in an upper half of the back region 130 and defines a space that is proximal the vertical center of the back region 130. The space defined by the keyboard sheath 200 has a depth 230 between the neck region 103 and the waist region 102 that is longer than a width 232 between the left torso region 105 and the right torso region 104. The opening 220 extends in a generally horizontal direction relative to the orientation in which the garment 100 is typically worn (e.g., extending between a location proximal the right shoulder region 152 and the left shoulder region 172). As such, the opening 220 provides primarily vertical access to the pocket 210. In some embodiments, configuration of the keyboard sheath 200 can resemble a kangaroo's pouch.

In some embodiments, the dimensions of the pocket 210 can be selected to accommodate on the size of a typical, full-size personal computer (PC) gaming keyboard. For example, a PC keyboard can be about 17 inches wide and 6 inches deep. In such an example, the opening 220 can be a bit wider than 6 inches in order to accommodate rotated, vertical insertion of the keyboard, and the depth 230 can be about 14-18 inches deep.

Referring now to FIG. 2C, the garment 100 is shown with the keyboard sheath 200 in an example of use. In general, the vertical pocket 210 is configured to hold most (e.g., half or more) of a personal computer (PC) gaming keyboard 191 in a vertical orientation (e.g., with width of the keyboard rotated into the vertical direction). The remainder of the keyboard 191 visibly extends vertically through the opening 220 toward the neck region 103. For example, some gamers may consider their gaming keyboards to be very important and/or very personal tools of their trade, and the keyboard sheath 200 can provide a place where their personal keyboard can be transported while leaving their hands/arms free, while also displaying the keyboard (e.g., as a status symbol, to make brand/sponsor logos on the keyboard visible to others).

A retainer 240 is configured to at least partly close the opening 220. In the illustrated example, the retainer 240 can be extended between the neck region 103 on the back region 130 and the opening 220 to hold the keyboard 191 in place and prevent it from falling out. The retainer 240 is substantial enough to retain the keyboard 191 while also permitting the upper portion to remain exposed (e.g., to be seen for status or sponsorship purposes). In the illustrated example, the retainer 240 is partly formed of hook-and-loop fastener, but in some embodiments other forms of fasteners may be used (e.g., snaps, buckles, magnets, buttons, elastic, laces).

Quick Draw Reversed Pockets

Figure 7:
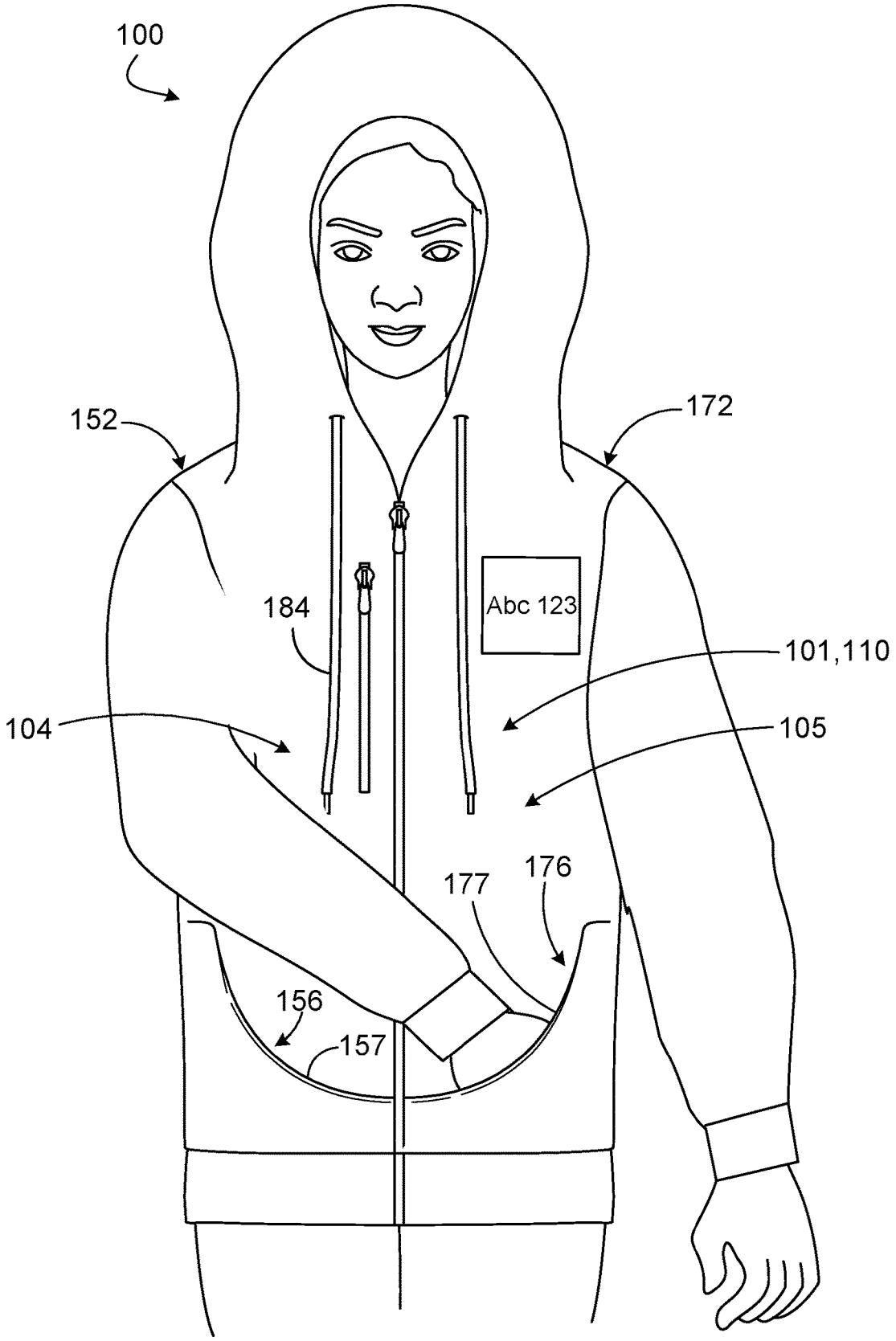
FIG. 7 is another front view of the example garment of FIGS. 1A-6.

Referring mainly to FIG. 7, the torso region 101 of the chest region 110 of the example garment 100 includes a front right pocket 156 and a front left pocket 176. The front right pocket 156 includes a right opening 157 in the right torso region 104 proximal the waist region 102 on the chest region 110. The front left pocket 176 includes a left opening 177 in the left torso region 105 proximal the waist region 102 on the chest region 110.

Traditional "hoodie" designs sometimes include front pockets, and these pockets are generally configured either as a horizontal tube across the wearer's abdomen (e.g., for pullover designs) or separate left and right pockets (e.g., for zip-up designs). In general, traditional pocket designs are oriented to make it easy for the right hand to enter the opening of the right pocket and for the left hand to enter the opening of the left pocket.

The front pockets 156, 176 of the garment 100 differ from traditional pockets. In general, the front pockets 156, 176 are "reversed" relative to traditional pockets. The right opening 157 is at least partly oriented toward the left torso region 105 across the chest region 110, and the left opening 177 is at least partly oriented toward the right torso region 104 across the chest region 110. For example, the right opening 157 opens diagonally toward the left shoulder region 172, while the left opening 177 opens diagonally toward the right shoulder region 152. In such orientations, the wearer can easily access the front right pocket 156 by reaching his/her left hand across his/her abdomen and through the right opening 157, and/or can easily access the front left pocket 176 by reaching his/her right hand across his/her abdomen and through the left opening 177.

In some implementations, the front pockets 156, 176 are oriented to provide easy access for a wearer of the garment 100 in confined spaces, such as a crowd or a racecar-style gaming seat. For example, the front pockets 156, 176 can provide easy access to a game controller 192 without the wearer having to stand up or extend an elbow far behind them in order to reach into the pockets. Instead, the user simply reaches his/her hand into the reversed opening on the opposite side of their stomach area. In some implementations, the front pockets 156, 176 can reduce the chances of theft or accidental loss of their contents. For example, with the front pockets 156, 176, a pickpocket may have to approach the wearer from the front rather than from the sides or back. In another example, the wearer may play games while in a somewhat reclined position in which traditional pockets with rearward openings would permit their contents to fall out, whereas the front pockets 156, 176 would become increasingly secure in a reclined position (e.g., more vertical and pouch-like relative to gravity).

Figure 8:
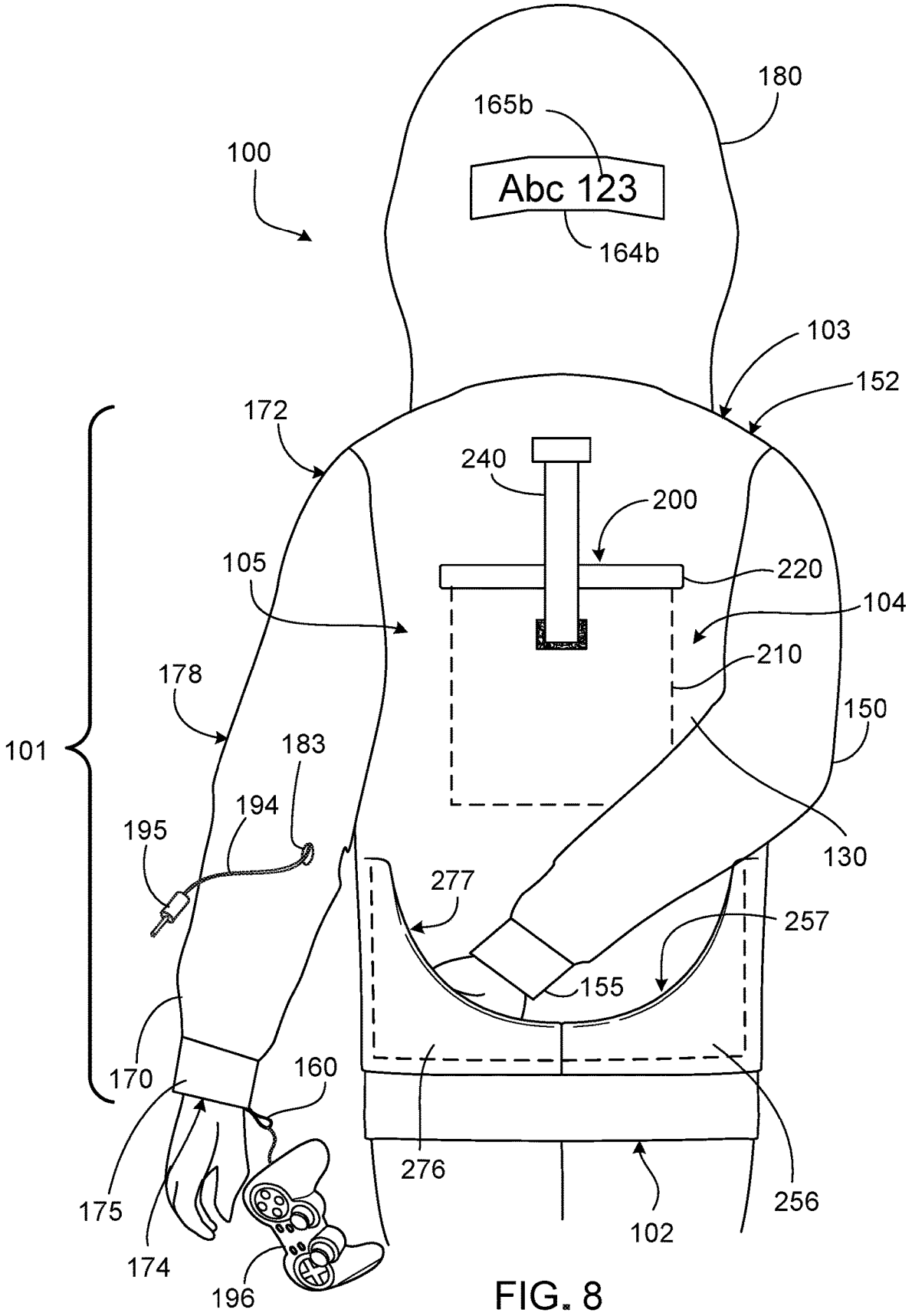
FIG. 8 is another rear view of the example garment of FIGS. 1A-7.

Referring mainly to FIG. 8, the torso region 101 of the back region 130 of the example garment 100 includes a back right pocket 256 and a back left pocket 276. The back right pocket 256 includes a right opening 257 in the right torso region 104 proximal the waist region 102 on the back region 130. The back left pocket 276 includes a left opening 277 in the left torso region 105 proximal the waist region 102 on the back region 130.

The right opening 257 is at least partly oriented toward the left torso region 105 across the back region 130, and the left opening 277 is at least partly oriented toward the right torso region 104 across the back region 130. For example, the right opening 257 opens diagonally toward the left shoulder region 172, while the left opening 277 opens diagonally toward the right shoulder region 152. In such orientations, the wearer can easily access the back right pocket 256 by reaching his/her left hand across his/her lower back and through the right opening 257, and/or can easily access the back left pocket 276 by reaching his/her right hand across his/her lower back and through the left opening 277. For example, the back pockets 256, 276 can provide easy access to a game controller 193 (FIG. 2C) by simply reaching behind his or her back.

Cord Keep

Referring again to FIGS. 1A-8, the left sleeve 170 includes a channel 185 (e.g., a passage for cords). The channel 185 defines a tubular cavity that is configured to retain a section one or more electrical (e.g., wires) or optical (e.g., fiber optic) conductors, such as a cord 194 of the communication headset 190. The channel 185 extends between an opening 181 proximal to the neck region 103, an opening 182 proximal the wrist opening 174 (FIGS. 1A-1C), and an opening 183 proximal an elbow region 178.

In some embodiments, the channel 185 can be a fold or loop of fabric of the sleeve 170 that is sewn, adhered, or otherwise affixed to the sleeve 170, and the cord 194 can be threaded through the channel 185 from the opening 181 to the opening 182 or the opening 183. For example, the communication headset 190 can come equipped with its own fixed or detachable cord. The wearer can run the cord through the channel 185 so the upper end of the cord 194 exits near the wearer's neck/head, and the other end exits near the wearer's elbow or wrist. In use, the channel 185 can keep the cord 194 out of the wearer's way to prevent the wearer from becoming entangled. In some embodiments, the channel 185 may be open along part of its length. For example, the channel 185 may be made of a collection of loops through which the cord 194 may be passed. In some embodiments, the channel 185 may be openable and reclosable along one or more portions of its length. For example, the channel 185 may include a zipper or hook-and-loop fastener that allows the channel 185 to be opened along at least a portion of its length so the cord 194 may be placed inside and then have the channel 185 be reclosed to retain the cord 194 inside.

In some implementations, the wearer may wish to have the cord 194 exit the opening 182. For example, many console games provide a communications port in a handheld gaming controller, and the opening 182 can provide an exit for the cord 194 that is near the controller. In a different example, PC gaming configurations may provide a communications port on the PC itself and the opening 183 may be used to keep the cord away from the wearer's hands during gameplay.

In some embodiments, the channel 185 may be (or include) a semi-rigid conduit. For example, a tube having an interior with a smooth surface and an inner diameter that is larger than the outer diameter of the cord 194 and/or a plug 195 terminating the cord 194. During assembly, the tube may ease the task of threading the cord 194 through the channel. In use, the tube may provide protection for the cord 194 (e.g., against cutting or abrasion) and/or strain relief (e.g., preventing overly tight bends). In some embodiments, the semi-rigid tube may include a lengthwise split that eases insertion and removal of the cord 194 from the length of the tube.

In some examples, the garment 100 can include the cord 194. For example, the garment 100 can be constructed with one or more electrically and/or optically isolated conductors pre-assembled into the sleeve 170, and having a plug or jack at or near the opening 181 and another plug or jack at or near the opening 182 or 183. In use the wearer can plug the communication headset 190 into the built-in cord near the neck region 103, and plug the built-in cord (e.g., directly or indirectly) into a communications port of a gaming controller, console, or PC.

Although the illustrated example shows the channel 185 and the cord 194 in association with the left sleeve 170, in some examples the channel 185 and the cord 194 could be part of the right sleeve 150 instead, or similar channels could be included as part of both of the sleeves 150, 170.

Controller Tether

The left sleeve 170 of the example garment 100 also includes a retainer 160. The retainer 160 is a tether that is configured to be affixed to an electronic game controller 196. In use, the retainer 160 can help keep the controller 196 close to the wearer's hand (e.g., when quickly switching between use of a keyboard and the controller 196). In some embodiments, the retainer 160 can include a hook, clasp, carabineer, clip, tie-able cord, loop of hook-and-loop fastener, or any other appropriate form of apparatus that can releasably retain a gaming controller or other device.

Although the illustrated example shows the retainer 160 in association with the left sleeve 170, in some examples the retainer 160 could be part of the right sleeve 150 instead, or similar retainers could be included as part of both of the sleeves 150, 170.

Electronic Device "Quarterback" Pocket

The example garment 100 includes an electronic device pocket 162 proximal the wrist opening 154 and the expandable cuff 155 of the right sleeve 150. The electronic device pocket 162 is sized and configured to retain an electronic device, such as a smart phone, a small computer tablet, a handheld remote controller, or any other appropriate handheld electronic device.

The electronic device pocket 162 is at least partly made of a substantially transparent material (e.g., flexible plastic film) arranged as a window into the pocket 162, to permit viewing of a display of the electronic device that is retained inside. For example, the electronic device pocket 162 can be used to hold the wearer's smart phone and keep in a location where it is readily visible, similar to the position of a wristwatch or a playbook wristband similar to those worn by American football quarterbacks. In some examples, gamers may have a companion application running on their smart phone (e.g., a map, a team communication link, an inventory list, auxiliary gaming controls) while gaming, and the electronic device pocket 162 can be used to keep their phone in a convenient location on their forearm.

The window of the electronic device pocket 162 is made of a material that is touchscreen compatible, in that the window material permits interaction between a user and a capacitive touchscreen user interface of a device within the electronic device pocket 162. For example, the wearer of the garment 100 may wish to not only view a smart phone or other device within the pocket 162, but also interact with the device (e.g., push onscreen buttons).

Although the illustrated example shows the electronic device pocket 162 being on the right sleeve 150, in some examples the pocket 162 could be part of the left sleeve 170 instead, or similar pockets could be included as part of both of the sleeves 150, 170.

Patch Pads

The example garment 100 also includes an affixment point 164*a* and an affixment point 164*b*. The affixment points 164*a*, 164*b* provide features that act as attachment points configured to releasably retain additional accessories to the garment 100. In some embodiments, the affixment points 164*a*, 164*b* include fasteners (e.g., hook-and-loop pads, snaps, magnets) that can releasably couple with mating fasteners of accessory items that the wearer can add and remove to/from the garment. In the illustrated example, the affixment points 164*a*, 164*b* are hook-and-loop pads that provide a location to which a removable patch 165*a* and a removable patch 165*b* (e.g., team logos, sponsor messaging, advertisements) are temporarily secured to the garment 100. In other examples, the affixment points 164*a*, 164*b* can be used to temporarily attach auxiliary gaming controllers, electronic devices (e.g., to pin a first-person-view livestream camera onto the wearer), personal items (e.g., hydration tube, personal fan), or any other appropriate accessory. In some embodiments, more or fewer of the affixment points 164*a*, 164*b* can be located at any appropriate location on or inside the garment 100.

In some embodiments, the affixment points 164*a*, 164*b* can provide structure for the removable patches 165*a*, 165*b*. For example (e.g., FIG. 2C), the affixment point 164*b* can include a panel of stiff backing material (e.g., plastic) that can keep the removable patch 165*b* at least semi-erect. In use, such stiffeners can help keep the removable patch 165*b* visible even when the hood 180 is down. In some examples, by keeping the removable patch 165*b* visible, the stiffeners can help enhance identification, publicity, and/or sponsorship value of the removable patch 165*b* for the wearer of the garment 100.

Lapel Pocket

The example garment 100 also includes a lapel pocket 166. The lapel pocket 166 is provided upon the chest region 110 and includes a fastener (e.g., zipper, hook-and-loop strip). In use, personal items or other objects may be stowed in the lapel pocket 166 and retained behind the fastener.

Although a few implementations have been described in detail above, other modifications are possible. For example, other components may be added to, or removed from, the described garments. Accordingly, other embodiments are within the scope of the following claims.

What is claimed is:

1. A hooded garment, comprising:

a torso section extending from a waist region to a neck region, wherein the torso section comprises a chest region and a back region, the torso section comprising a lapel pocket on the chest region and configured to be proximate a wearer's chest;

a hood extending upward from the neck region and having a front opening, wherein the hood is oversized and configured to provide room for a wearer's head and a headset on the wearer's head;

one or more affixment points configured to removably affix ornamental patches to the hooded garment, where a first affixment point of the one or more affixment points is positioned at a rear end of the hood, and the hooded garment comprises a first ornamental patch selectively affixed to the first affixment point, wherein the first ornamental patch is configured to be visible with the hood up or down;

a right sleeve extending from a right shoulder region of a right torso region and having a first wrist opening; and a left sleeve extending from a left shoulder region of a left torso region and having a second wrist opening.

2. The hooded garment of claim 1, wherein the torso section comprises at least one of:

a front right pocket comprising a first opening in the right torso region proximal the waist region on the chest region, the first opening being at least partly oriented toward the left torso region across the chest region; and a front left pocket comprising a second opening in the left torso region proximal the waist region on the chest region, the second opening being at least partly oriented toward the right torso region across the chest region.

3. The hooded garment of claim 1, wherein at least one of the right sleeve or the left sleeve further comprises a channel having at least a first opening proximal the neck region and a second opening proximal at least one of an elbow region and the first wrist opening or the second wrist opening.

4. A hooded garment, comprising:

a torso section extending from a waist region to a neck region, wherein the torso section comprises a chest region and a back region;

a hood extending upward from the neck region and having a front opening, wherein the hood is oversized and configured to provide room for a wearer's head and a headset on the wearer's head;

one or more affixment points configured to removably affix ornamental patches to the hooded garment, where a first affixment point of the one or more affixment points is positioned at a rear end of the hood, and the hooded garment comprises a first ornamental patch selectively affixed to the first affixment point, wherein the first ornamental patch is configured to be visible with the hood up or down;

a right sleeve extending from a right shoulder region of a right torso region and having a first wrist opening; and a left sleeve extending from a left shoulder region of a left torso region and having a second wrist opening;

wherein the torso section further comprises at least one of:

a front right pocket comprising a first opening in the right torso region proximal the waist region on the chest region, the first opening being at least partly oriented toward the left torso region across the chest region;

a front left pocket comprising a second opening in the left torso region proximal the waist region on the chest region, the second opening being at least partly oriented toward the right torso region across the chest region;

a back right pocket comprising a third opening in the right torso region proximal the waist region on the back region, the third opening being at least partly oriented toward the left torso region across the back region; and a back left pocket comprising a fourth opening in the left torso region proximal the waist region on the back region, the fourth opening being at least partly oriented toward the right torso region across the back region.

5. The hooded garment of claim 4, wherein at least one of the right sleeve and the left sleeve further comprises a channel having at least a first opening proximal the neck region and a second opening proximal at least one of an elbow region and the first wrist opening or the second wrist opening.

6. The hooded garment of claim 5, further comprising an electrical cord assembly comprising a plurality of electrically isolated conductors at least partly retained within the channel, the electrical cord assembly having a first end proximal the neck region and extending to a second end proximal at least one of the elbow region and the first wrist opening or the second wrist opening.

7. The hooded garment of claim 4, wherein at least one of the right sleeve or the left sleeve further comprises an electronic device pocket proximal to the first wrist opening or the second wrist opening and comprising a substantially transparent window configured to permit viewing of a display of an electronic device secured within the electronic device pocket.

8. A hooded garment, comprising:

a torso section extending from a waist region to a neck region, wherein the torso section comprises a right torso region, a left torso region, a chest region, and a back region;

a hood extending upward from the neck region and having a front opening, wherein the hood is oversized and configured to provide room for a wearer's head and a headset on the wearer's head;

one or more affixment points configured to removably affix ornamental patches to the hooded garment, where a first affixment point of the one or more affixment points is positioned at a rear end of the hood, and the hooded garment comprises a first ornamental patch selectively affixed to the first affixment point, wherein the first ornamental patch is configured to be visible with the hood up or down;

a right sleeve extending from a right shoulder region of the right torso region and having a first wrist opening; and a left sleeve extending from a left shoulder region of the left torso region and having a second wrist opening;

wherein at least one of the right sleeve or the left sleeve further comprises a channel having at least a first opening proximal the neck region and a second opening proximal at least one of an elbow region, or the first wrist opening or the second wrist opening.

9. The hooded garment of claim 8, wherein the torso section comprises at least one of:

a front right pocket comprising a first opening in the right torso region proximal the waist region on the chest region, the first opening being at least partly oriented toward the left torso region across the chest region; and a front left pocket comprising a second opening in the left torso region proximal the waist region on the chest region, the second opening being at least partly oriented toward the right torso region across the chest region.

10. The hooded garment of claim 8, further comprising an electrical cord assembly comprising a plurality of electrically isolated conductors at least partly retained within the channel, the electrical cord assembly having a first end proximal the neck region and extending to a second end proximal at least one of the elbow region and the first wrist opening or the second wrist opening.

11. The hooded garment of claim 1, wherein the lapel pocket comprises a lapel pocket opening oriented vertically on the chest region.

12. The hooded garment of claim 1, further comprising one or more ornamental patches selectively affixed to the hooded garment at the one or more affixment points.

13. The hooded garment of claim 1, wherein the one or more affixment points comprises at least one of hook-and-loop pads, snaps, or magnets configured to selectively affix ornamental patches.

14. The hooded garment of claim 1, wherein the hood comprises at least one layer of fabric and at least one layer of sound-deadening material configured for acoustic isolation for the wearer.

15. The hooded garment of claim 1, wherein the front opening of the hood extends forward beyond the chest region, the hood configured to extend forward beyond a wearer's face.

16. The hooded garment of claim 1, wherein the hood comprises a retainer configured to selectively attach the headset to the hood.

17. The hooded garment of claim 4, wherein the torso section comprising a lapel pocket on the chest region and configured to be proximate a wearer's chest.

18. The hooded garment of claim 17, wherein the lapel pocket comprises a lapel pocket opening oriented vertically on the chest region.

19. The hooded garment of claim 4, further comprising one or more ornamental patches selectively affixed to the hooded garment at the one or more affixment points, the one or more ornamental patches comprising the first ornamental patch.

20. The hooded garment of claim 4, wherein the one or more affixment points comprises at least one of hook-and-loop pads, snaps, or magnets configured to selectively affix ornamental patches.

21. The hooded garment of claim 4, wherein the hood comprises at least one layer of fabric and at least one layer of sound-deadening material configured for acoustic isolation for the wearer.

22. The hooded garment of claim 4, wherein the front opening of the hood extends forward beyond the chest region, the hood configured to extend forward beyond a wearer's face.

23. The hooded garment of claim 4, wherein the hood comprises a retainer configured to selectively attach the headset to the hood.

24. The hooded garment of claim 8, wherein the torso section comprising a lapel pocket on the chest region and configured to be proximate a wearer's chest.

25. The hooded garment of claim 24, wherein the lapel pocket comprises a lapel pocket opening oriented vertically on the chest region.

26. The hooded garment of claim 8, further comprising one or more ornamental patches selectively affixed to the hooded garment at the one or more affixment points, the one or more ornamental patches comprising the first ornamental patch.

27. The hooded garment of claim 8, wherein the one or more affixment points comprises at least one of hook-and-loop pads, snaps, or magnets configured to selectively affix ornamental patches.

28. The hooded garment of claim 8, wherein the hood comprises at least one layer of fabric and at least one layer of sound-deadening material configured for acoustic isolation for the wearer.

29. The hooded garment of claim 8, wherein the front opening of the hood extends forward beyond the chest region, the hood configured to extend forward beyond a wearer's face.

30. The hooded garment of claim 8, wherein the hood comprises a retainer configured to selectively attach the headset to the hood.

* * * * *